US005678523A

United States Patent [19]

Hashimoto et al.

[11] Patent Number: 5,678,523

[45] Date of Patent: Oct. 21, 1997

[54] EVAPORATIVE FUEL-PROCESSING SYSTEM FOR INTERNAL COMBUSTION ENGINES

[75] Inventors: Akira Hashimoto; Hideo Moriwaki; Yoshiaki Matsuzono; Sachito Fujimoto, all of Wako; Satoshi Kiso, Tochigi-ken, all of Japan

[73] Assignee: Honda Giken Kogyo Kabushiki Kaisha, Tokyo, Japan

[21] Appl. No.: 609,744

[22] Filed: Mar. 1, 1996

[30] Foreign Application Priority Data

Mar. 3, 1995 [JP] Japan ..... 7-070533

[51] Int. Cl.[6] ..... F02M 37/04

[52] U.S. Cl. ..... 123/520

[58] Field of Search ..... 123/516, 518, 123/519, 520, 198 D

[56] References Cited

U.S. PATENT DOCUMENTS

| | | | |
|---|---|---|---|
| 5,396,873 | 3/1995 | Yamanaka et al. | 123/520 |
| 5,460,141 | 10/1995 | Denz et al. | 123/520 |
| 5,460,143 | 10/1995 | Narita | 123/520 |
| 5,463,998 | 11/1995 | Denz et al. | 123/520 |
| 5,474,047 | 12/1995 | Cochard et al. | 123/520 |
| 5,476,083 | 12/1995 | Blumenstock | 123/520 |
| 5,499,613 | 3/1996 | Bayerle et al. | 123/520 |
| 5,542,397 | 8/1996 | Takahata et al. | 123/520 |

FOREIGN PATENT DOCUMENTS 6-173789 6/1994 Japan .

*Primary Examiner*—Thomas N. Moulis

*Attorney, Agent, or Firm*—Nikaido, Marmelstein, Murray & Oram LLP

[57] ABSTRACT

An evaporative fuel-processing system for an internal combustion engine has an evaporative emission control system and a pressure sensor. An ECU carries out negative pressurization of the interior of the evaporative emission control system, by opening a purge control valve and closing a vent shut valve. The purge control valve is closed over a predetermined time period after the interior of the evaporative emission control system is brought into the predetermined negatively pressurized state, and a rate of decrease in negative pressure within the evaporative emission control system is detected. Then, it is determined whether or not there is leakage from the evaporative emission control system, based on the detected rate of decrease in the negative pressure, and at least one detected pressure value at at least one predetermined time point within the predetermined time period over which the purge control valve is closed.

12 Claims, 8 Drawing Sheets

CORRECTIVE CHECKING MODE
S71
FEVP4=1 ?
NO
YES
S72
EXECUTE CORRECTIVE CHECKING
BPS CLOSE
VSSV CLOSE
PCS CLOSE
S73
T≧T41 ?
NO
YES
S74
P4←PTANK
S75
T≧T4 ?
NO
YES
S76
DP4←PTANK−P4
S77
DP3−DP4 <PT4 ?
NO,LEAK BY φ 0.04-INCH HOLE
YES
S78
DETERMINE EVAPORATIVE PURGING SYSTEM IS NORMAL
S79
DETERMINE EVAPORATIVE PURGING SYSTEM UNDERGOES FAILURE
S80
TERMINATE MONITORING
EXIT

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which purges evaporative fuel generated in the fuel tank into the intake system of the engine, and more particularly to an evaporative fuel-processing system of this kind, which has a function of determining whether or not a leak occurs in an evaporative emission control system which extends from the fuel tank to the intake system of the engine.

2. Prior Art

Conventionally, there are known abnormality-determining methods which determine whether a leak occurs in an evaporative emission control system of an internal combustion engine, which includes a canister for adsorbing evaporative fuel generated in the fuel tank, and a purging passage connecting between the canister and the intake system of the engine. These methods include a method which carries out negative pressurization by introducing negative pressure within the intake system of the engine into the interior of the evaporative emission control system, and then seals the evaporative emission control system, followed by determining whether the evaporative emission control system undergoes leakage depending on the state of the negative pressure held within the evaporative emission control system (leak checking).

However, the pressure within the evaporative emission control system is not stabilized immediately after completion of negative pressurization, which results in degradation of the accuracy of the leak checking. To overcome this inconvenience, the present assignee proposed an evaporative fuel-processing system, for example, by Japanese Laid-Open Patent Publication (Kokai) No. 6-173789, in which leak checking is delayed for a predetermined time period after completion of negative pressurization.

According to the above proposed system, if a pressure sensor for detecting the pressure within the evaporative emission control system is inserted into an evaporative fuel passage extending between the fuel tank and the canister, negative pressurization can be carried out even if a large hole is present, e.g. in the fuel tank. (such as a case where a filler cap of the fuel tank is removed). However, the pressure within the fuel tank increases to a value nearly as high as the atmospheric pressure during the delay time. Consequently, a change in the pressure can be too small during the leak checking carried out thereafter to accurately determine presence of a leak from the evaporative emission control system.

Further, if the leak checking is carried out by the use of the pressure sensor inserted into the evaporative fuel passage between the fuel tank and the canister, while a cut-off valve, which operates to prevent liquid fuel from flowing from the fuel tank to the canister when the fuel tank is full, is closed to shut off the evaporative fuel passage, the interior of the fuel tank is not negatively pressurized during the negative pressurization preceding the leak checking. Thereafter, when the fuel tank is communicated with the evaporative fuel passage during the following leak checking, an output from the pressure sensor increases, which leads to an erroneous leak checking result that the pressure largely changes and hence a leak has occurred even though no leak has actually occurred.

SUMMARY OF THE INVENTION

It is the object of the invention to provide an evaporative fuel-processing system for internal combustion engines, which is capable of accurately determining whether a leak occurs from the evaporative emission control system, by discriminating a state where the evaporative emission control system has a large hole, a state where the cut-off valve of the fuel tank is closed, etc.

To attain the above object, the present invention provides an evaporative fuel-processing system for an internal combustion engine having an intake system, and a fuel tank, comprising:

an evaporative emission control system including a canister having an adsorbent accommodated therein, for adsorbing evaporative fuel generated in the fuel tank, and an air inlet port communicating with atmosphere, a charging passage extending between the canister and the fuel tank, a purging passage extending between the canister and the intake system, a purge control valve arranged across the purging passage, and a vent shut valve for opening and closing the air inlet port of the canister;

pressure-detecting means for detecting pressure within the evaporative emission control system;

negatively pressurizing means for negatively pressurizing an interior of the evaporative emission control system into a predetermined negatively pressurized state, by opening the purge control valve and closing the vent shut valve;

leakage-checking means for closing the purge control valve over a predetermined time period after the interior of the evaporative emission control system is brought into the predetermined negatively pressurized state by the negatively pressurizing means, and for detecting a rate of decrease in negative pressure within the evaporative emission control system; and leakage-determining means for determining whether or not there is leakage from the evaporative emission control system, based on the rate of decrease in the negative pressure within the evaporative emission control system detected by the leakage-checking means, and at least one pressure value detected by the pressure-detecting means at at least one predetermined time point within the predetermined time period over which the purge control valve is closed.

Preferably, the evaporative fuel-processing system includes pressure-recovering means for relieving the interior of the evaporative emission control system into the atmosphere after lapse of the predetermined time period over which the purge control valve is closed by the leakage-checking means, to bring the evaporative emission control system into an open-to-atmosphere state in which the pressure within the evaporative emission control system is substantially equal to atmospheric pressure, and wherein the leakage-determining means determines whether or not there is leakage from the evaporative emission control system, based on the rate of decrease in the negative pressure, and a difference between a pressure value detected by the pressure-detecting means when the emission control system was brought into the open-to-atmosphere state and the at least one pressure value detected by the pressure-detecting means at the at least one predetermined time point within the predetermined time period over which the purge control valve is closed.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
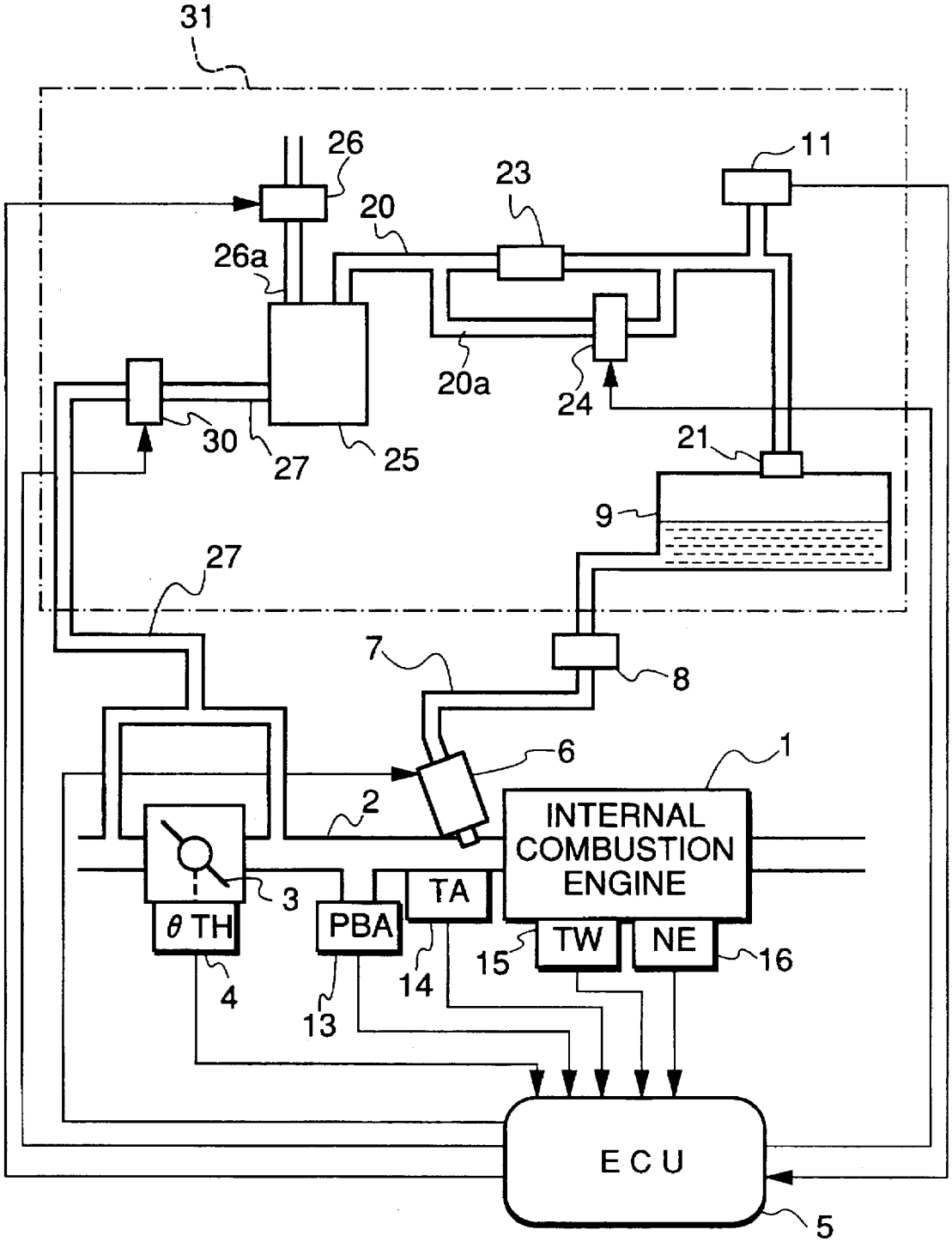
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted into a coolant passage formed in the cylinder block, which is filled with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Next, an evaporative emission control system (hereinafter referred to as "the evaporative purging system") 31 will be described, which is comprised of the fuel tank 9, a charging passage 20, a canister 25, a purging passage 27, etc.

The fuel tank 9 is connected to the canister 25 via the charging passage 20 extending between the fuel tank 9 and the canister 25. A cut-off valve 21 is arranged at one end of the charging passage 20 connected to the fuel tank 9. The cut-off valve 21 is a float valve which closes when the fuel tank 9 is full or when it is sharply tilted. A pressure sensor 11 is inserted into the charging passage 20, for supplying a signal indicative of the sensed pressure within the charging passage 20 to the ECU 5.

Further arranged across the charging passage 20 is a two-way valve 23 which is constructed such that it opens when pressure PTANK within the fuel tank 9 (tank internal pressure) is higher than atmospheric pressure by approximately 10 mmHg or more or when the tank internal pressure PTANK is lower than pressure on one side of the two-way valve 23 toward the canister 25 by a predetermined amount or more.

Further connected to the charging passage 20 is a bypass passage 20*a* which bypasses the two-way valve 23. Arranged across the bypass passage 20*a* is a bypass valve (BPS) 24 which is a normally-closed solenoid valve, and is opened and closed during execution of abnormality determination, described hereinafter, by a signal from the ECU 5.

The canister 25 contains activated carbon for adsorbing evaporative fuel, and has formed therein an air inlet port, not shown, which communicates with the atmosphere via a passage 26*a*. Arranged across the passage 26*a* is a vent shut valve (VSSV) 26, which is a normally-open solenoid valve, and is temporarily closed during execution of the abnormality determination, by a signal from the ECU 5.

The canister 25 is connected via the purging passage 27 to the intake pipe 2 at locations downstream and immediately upstream of the throttle valve 3. The purging passage 27 has a purge control valve (PCS) 30 arranged thereacross, which is a solenoid valve which is adapted to control the flow rate of a mixture of evaporative fuel and air as the on/off duty ratio of a control signal supplied to the valve from the ECU 5 is changed. Alternatively, the purge control valve 30 may be a linear solenoid valve whose valve lift can be linearly changed. If the alternative valve is used, a current signal indicative of the valve lift is supplied to the valve from the ECU 5 in place of the control signal indicative of the on/off duty ratio.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, bypass valve 24, vent shut valve 26, and purge control valve 30.

The CPU of the ECU 5 operates in response to the above-mentioned various engine parameter signals from the various sensors to control fuel injection periods of the fuel injection valves 6, and executes abnormality determination of the evaporative purging system 31 (determination as to leakage), based on a signal from the pressure sensor 11.

Figure 2:
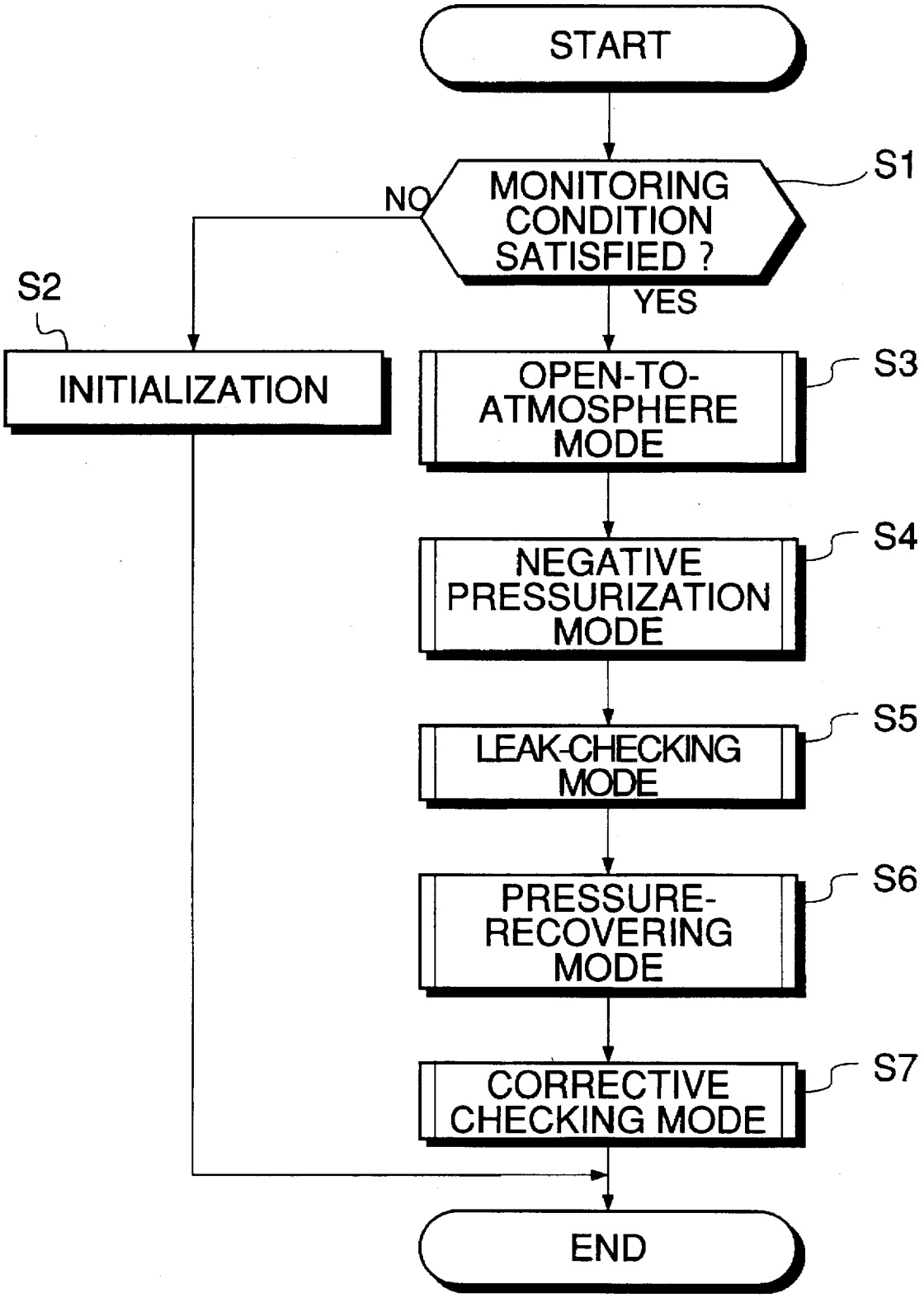
FIG. 2 is a flowchart showing a routine for carrying out a determination as to abnormality of an evaporative emission control system appearing in FIG. 1.

FIG. 2 shows a main routine for carrying out abnormality determination of the evaporative purging system 31, which is executed, for example, at predetermined time intervals.

First, at a step S1, it is determined whether or not monitoring conditions, i.e. conditions for permitting execution of abnormality determination are satisfied. The monitoring conditions are satisfied when the amount of evaporative fuel stored in the canister 25 is not large, and at the same time purging of evaporative fuel is being carried out at a sufficient rate so that the air-fuel ratio of an air-fuel mixture supplied to the engine does not fluctuate even if the abnormality determination is executed. If the answer is negative (NO), initialization is executed at a step S2, followed by terminating the present routine. The initialization is carried out such that an up-counting timer T to be used for processings described hereinafter is reset to "0", and an output value from the pressure sensor 11 (hereinafter referred to as "the tank internal pressure PTANK") generated at this time is stored as an initial pressure PINI. At the same time, if conditions for carrying out purging are then satisfied, normal purging is carried out by closing the bypass valve 24, opening the vent shut valve 26, and controlling the purge control valve 30, based on the duty ratio.

If the monitoring conditions are satisfied at the step S1, an open-to-atmosphere mode processing (at a step S3), a negative pressurization mode processing (at a step S4), a leak-checking mode processing (at a step S5), a pressure-recovering mode processing (at a step S6), and a corrective checking mode processing(at a step S7) are sequentially executed, followed by terminating the abnormality determination.

Figure 3:
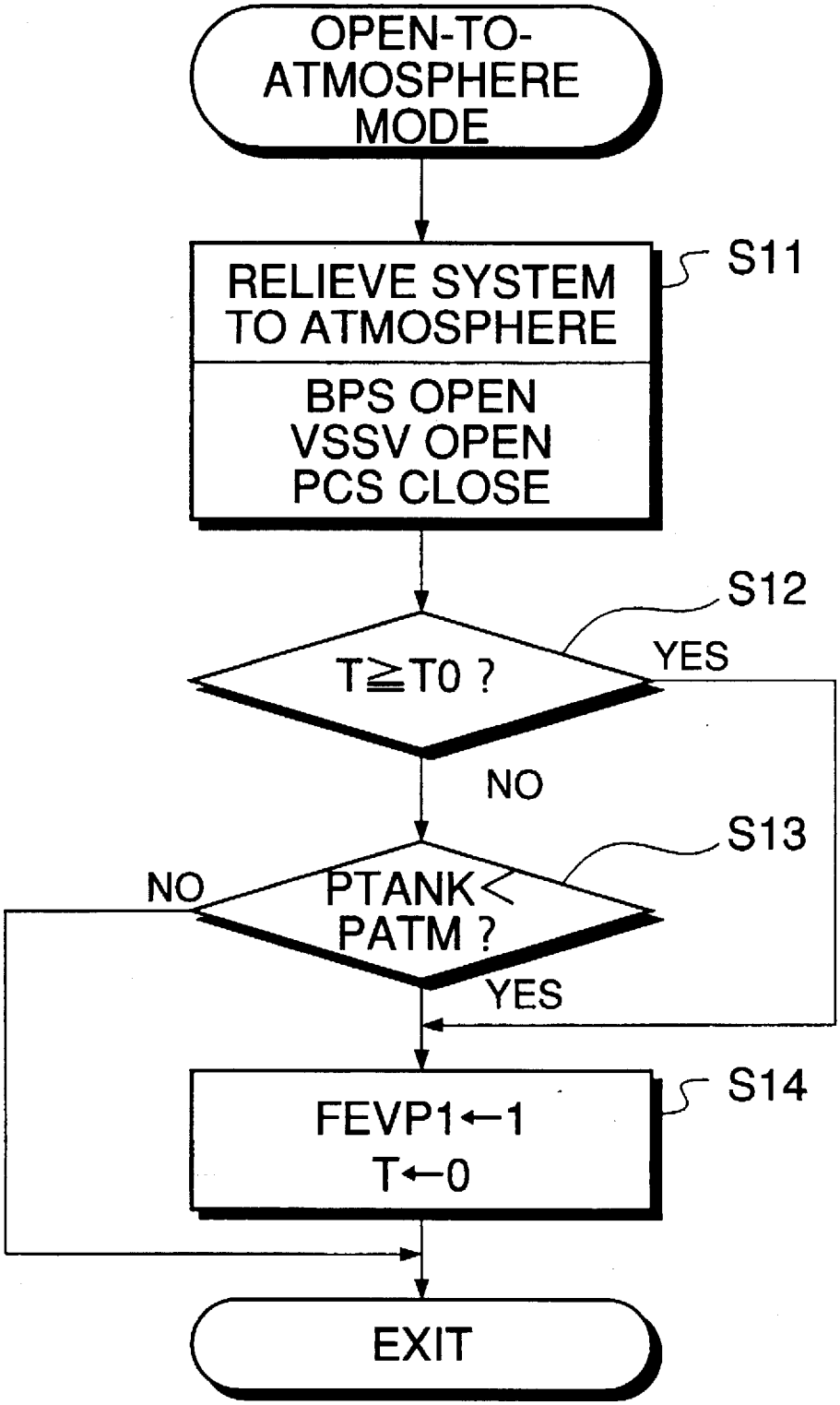
FIG. 3 is a program showing a subroutine for carrying out an open-to-atmosphere mode processing, which is executed at a step S3 in FIG. 2.
Figure 8:
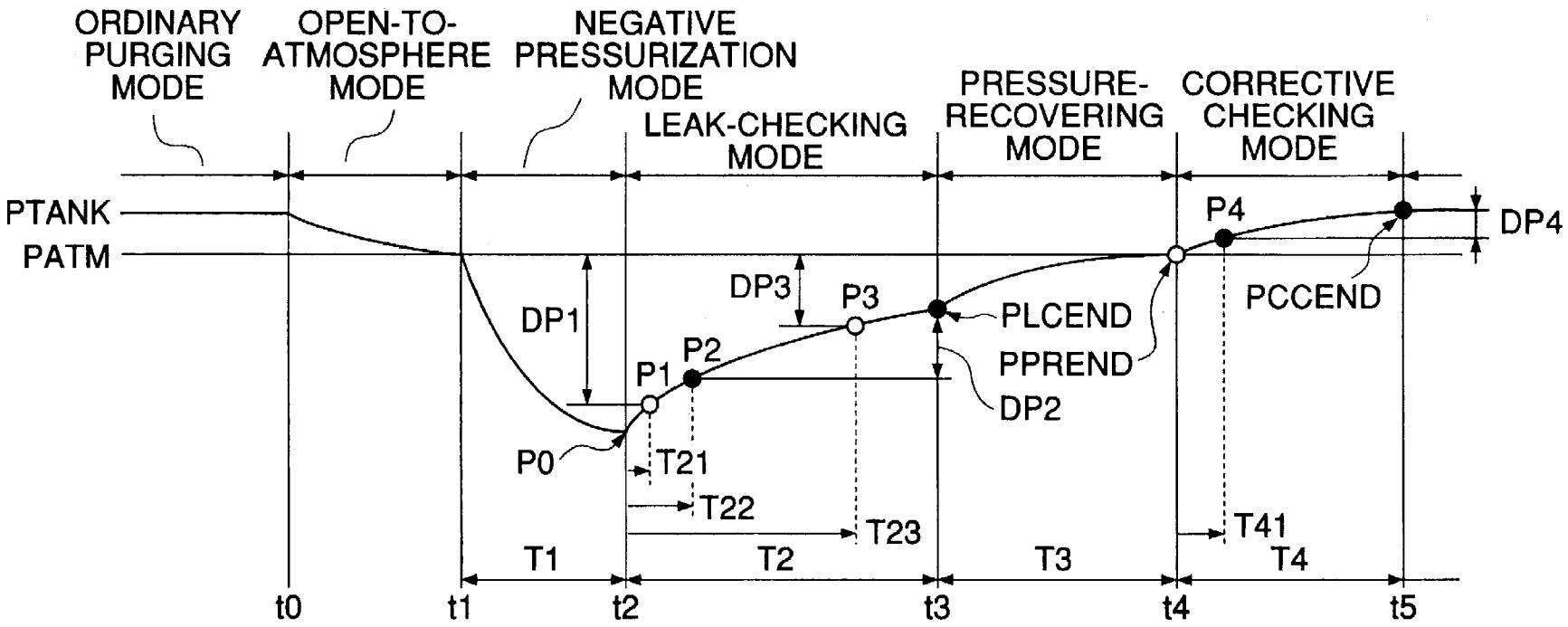
FIG. 8 is a timing chart showing changes in the tank internal pressure PTANK with the lapse of time.

FIG. 3 shows a subroutine for carrying out the open-to-atmosphere mode processing executed at the step S3 in FIG. 2 (corresponding to a time point t0 to a time point t1 in FIG. 8).

First, at a step S11, the open-to-atmosphere mode is set by opening the bypass valve 24 and the vent shut valve 26, and closing the purge control valve 30. Then, it is determined at a step S12 whether or not the value of the timer T is larger than a predetermined open-to-atmosphere time period T0. In the first loop of execution of the step S12, T<T0 holds, and then the program proceeds to a step S13, wherein it is determined whether or not the tank internal pressure PTANK is lower than atmospheric pressure PATM. In the first loop of execution of the step S13, usually the answer is negative (NO), and then the program is immediately terminated. If the predetermined open-to-atmosphere time period T0 has elapsed, the program proceeds from the step S12 to a step S14, wherein a negative pressurization mode permission flag FEVP1, which, when set to "1", indicates that execution of the negative pressurization mode is permitted, is set to "1" and at the same time the timer T is reset to "0", followed by terminating the present routine.

On the other hand, even if the predetermined open-to-atmosphere time period T0 has not elapsed, if PTANK<PATM holds at the step S13, the step S14 is executed, followed by terminating the present routine.

By executing the above processing, when the tank internal pressure PTANK initially assumes a value higher than the atmospheric pressure PATM, the PATM value drops to a value almost equal to the atmospheric pressure PATM (corresponding to the time point t1 in FIG. 8).

Figure 4:
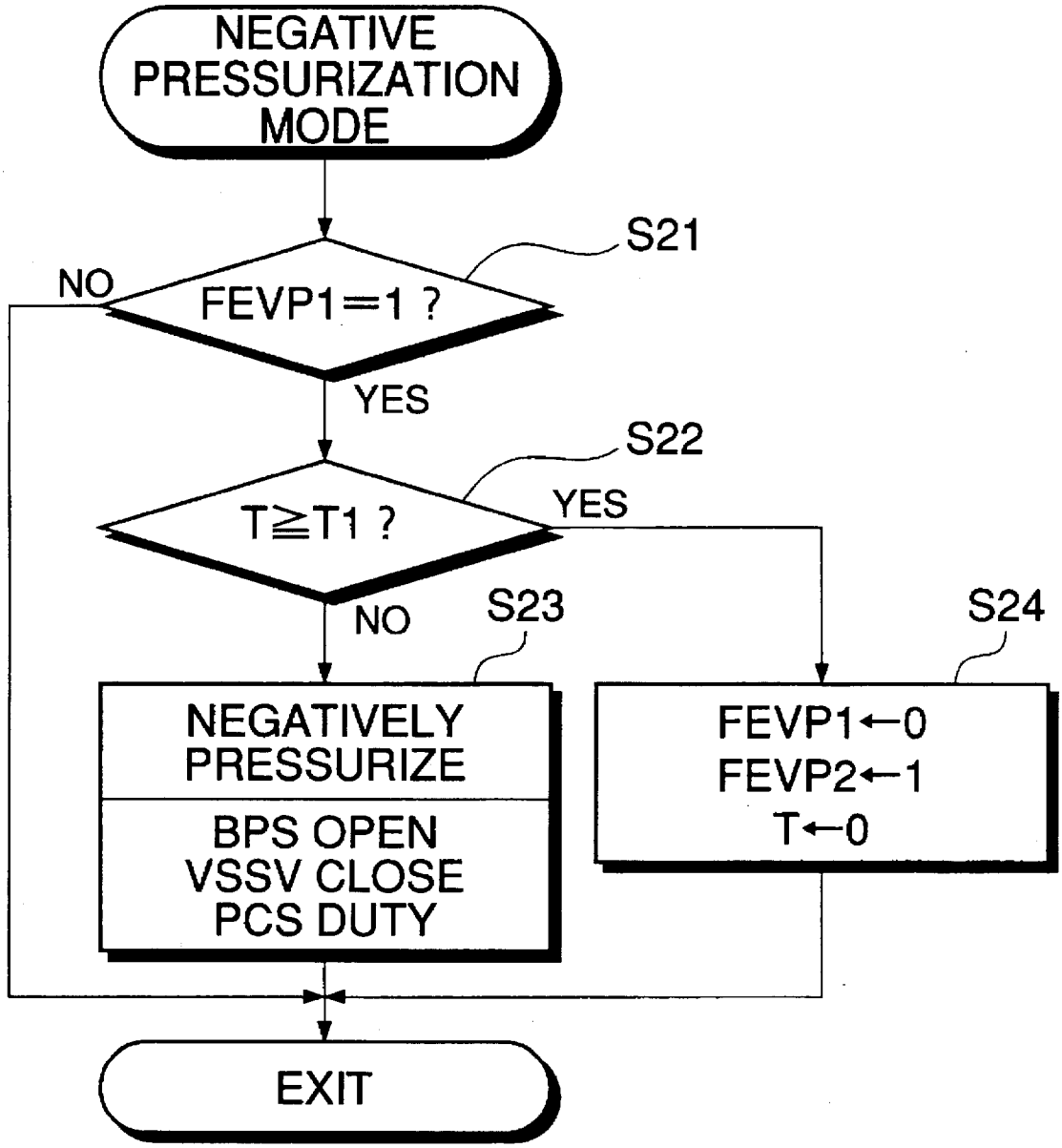
FIG. 4 is a flowchart showing a subroutine for carrying out a negative pressurization mode processing, which is executed at a step S4 in FIG. 2.

FIG. 4 shows a subroutine for carrying out the negative pressurization mode processing executed at the step S4 in FIG. 2 (corresponding to the time point t1 to a time point t2 in FIG. 8).

First, at a step S21, it is determined whether or not the negative pressurization mode permission flag FEVP1 has been set to "1". If FEVP1=0 holds, which means that execution of the negative pressurization mode is not permitted, the program is immediately terminated.

On the other hand, if FEVP1=1 holds at the step S21, it is determined at a step S22 whether or not the value of the timer T exceeds a predetermined negative pressurization time period T1. In the first loop of execution of the step S22, T<T1 holds, and therefore the negative pressurization mode is set by opening the bypass valve 24, closing the vent shut valve 26, and controlling the purge control valve 30, based on the duty ratio, followed by terminating the present routine. The duty control of the purge control valve 30 is carried out in the following manner: A desired flow rate table, not shown, stored beforehand in the memory means of the ECU 5 is retrieved to determine a desired purge flow rate QEVAP according to the tank internal pressure PTANK. The control duty ratio is determined according to the thus determined QEVAP value. The desired flow rate table is set such that the QEVAP value increases as the PTANK value increases.

When the predetermined negative pressurization time period T1 has elapsed, i.e. when T=T1 holds (the time point t2 in FIG. 8), the program proceeds to a step S24, wherein the negative pressurization mode permission flag FEVP1 is set to "0", and a leak-checking mode permission flag FEVP2, which, when set to "1", indicates that execution of the leak-checking mode is permitted, is set to "1" and at the same time the timer T is reset to "0", followed by terminating the present routine.

By executing the above processing, the negative pressure within the intake pipe 2 of the engine is introduced into the evaporative purging system 31, whereby the tank internal pressure PTANK drops to a value P0.

Figure 5:
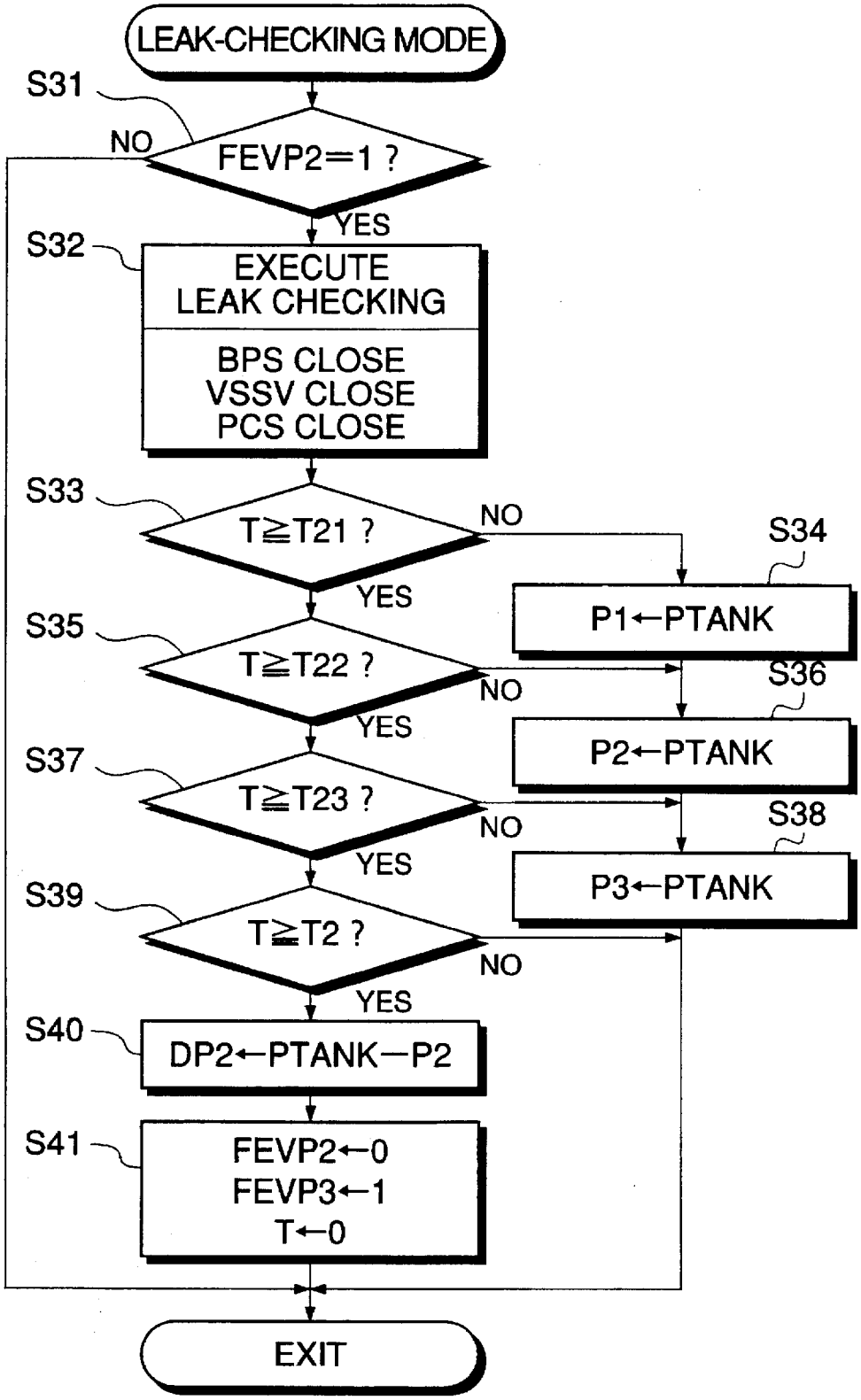
FIG. 5 is a flowchart showing a subroutine for carrying out a leak-checking mode processing, which is executed at a step S5 in FIG. 2.

FIG. 5 shows a subroutine for carrying out the leak-checking mode processing executed at the step S5 in FIG. 2 (corresponding to the time point t2 to a time point t3 in FIG. 8).

First, at a step S31, it is determined whether or not the leak-checking mode permission flag FEVP2 has been set to "1" If FEVP2=0 holds, i.e. if execution of the leak-checking mode is not permitted, the program is immediately terminated.

On the other hand, if FEVP2=1 holds, i.e. if execution of the leak-checking mode is permitted, the bypass valve 24, the vent shut valve 26, and the purge control valve 30 are all closed to execute the leak-checking mode at a step S32. At the following step S33, it is determined whether or not the value of the timer T exceeds a first predetermined time period T21. In the first loop of execution of the step S33, T<T21 holds, and then a present value of the tank internal pressure PTANK is set to a first detected pressure P1, a second detected pressure P2, and a third detected pressure P3, at respective steps S34, S36, and S38, followed by terminating the present routine.

When the first predetermined time period T21 has elapsed, the program proceeds from the step S33 to a step S35, wherein it is determined whether or not the value of the timer T exceeds a second predetermined time period T22. In the first loop of execution of the step S35, T<T22 holds, and then the second detected value P2 and the third detected value P3 are updated to a present value of the tank internal pressure PTANK at the respective steps S36 and S38, followed by terminating the present routine.

When the second predetermined time period T22 has elapsed, the program proceeds from the step S35 to a step S37, wherein it is determined whether or not the value of the timer T exceeds a third predetermined time period T23. In the first loop of execution of the step S37, T<T23 holds, and then the third detected value P3 is updated to a present value of the tank internal pressure PTANK at the step S38, followed by terminating the present routine.

When the third predetermined time period T23 has elapsed, the program proceeds from the step S37 to a step S39, wherein it is determined whether or not the value of the timer T exceeds a predetermined leakchecking time period T2. In the first loop of execution of the step S39, T<T2 holds, and then the program is immediately terminated.

By executing the step S33 to the step S38, as shown in FIG. 8, the tank internal pressure PTANK detected when the first predetermined time period T21 elapses from the leak-checking mode starting time point t2 is set to the first detected pressure P1, the tank internal pressure PTANK detected when the second predetermined time period T22 elapses from the time point t2 is set to the second detected pressure P2, and the tank internal pressure PTANK detected when the third predetermined time period T23 elapses from the time point t2 is set to the third detected pressure P3, respectively.

When the predetermined leak-checking time period T2 has elapsed from the time pint t2, the program proceeds from the step S39 to a step S40, wherein a pressure difference DP2 (=PLCEND–P2, hereinafter referred to as "the second pressure difference") between a present value of the tank internal pressure PTANK (tank internal pressure PLCEND assumed at the time point t3 in FIG. 8) and the second detected pressure P2 is calculated. Then, at a step S41, the leak-checking mode permission flag FEVP2 is set to "0", a pressure-recovering mode permission flag FEVP3, which, when set to "1", indicates that execution of the pressure recovering-mode is permitted, is set to "1", and the timer T is reset to "0", followed by terminating the present routine.

Figure 6:
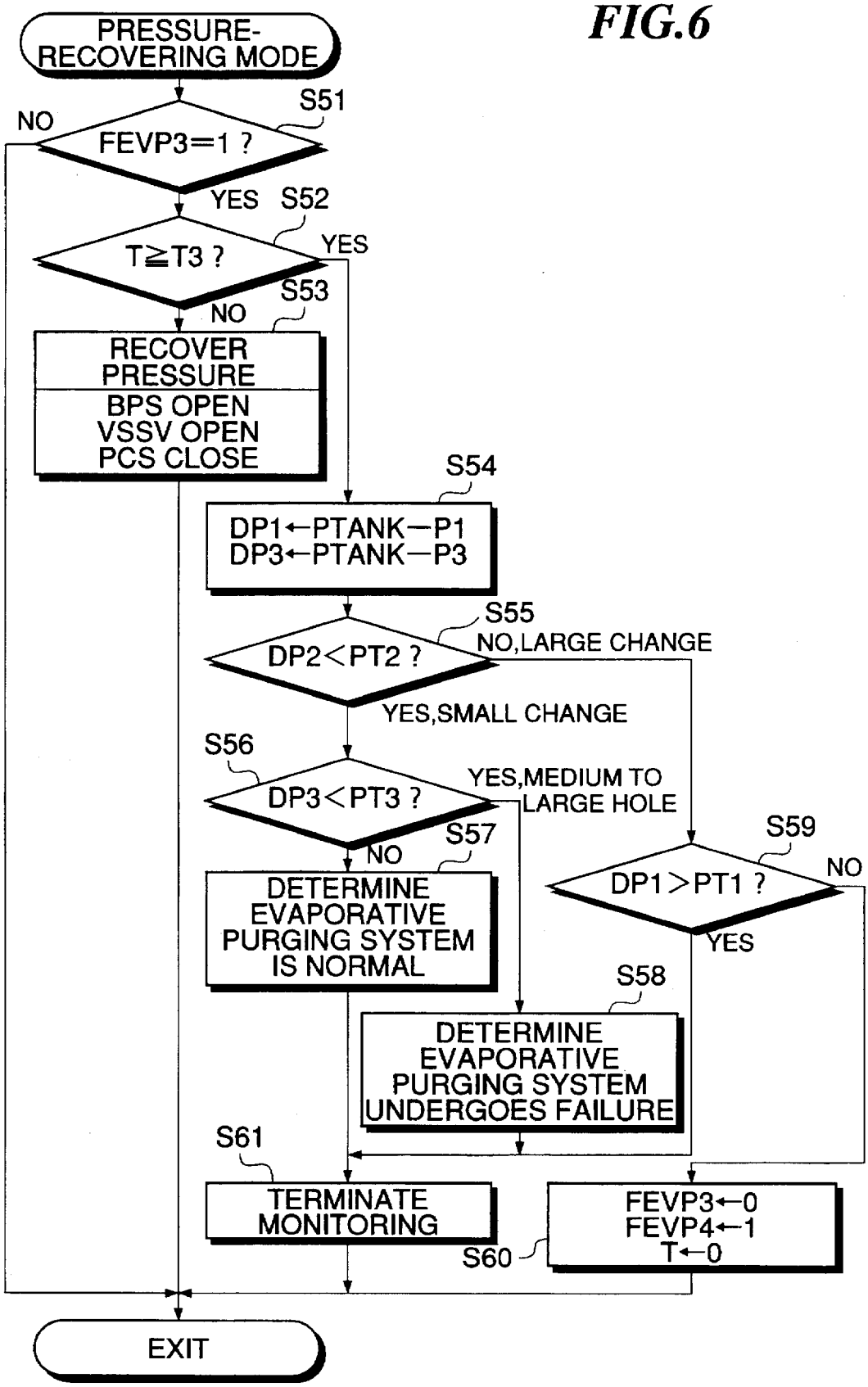
FIG. 6 is a flowchart showing a subroutine for carrying out a pressure-recovering mode processing, which is executed at a step S6 in FIG. 2.

FIG. 6 shows a subroutine for carrying out the pressure-recovering mode processing executed at the step S6 in FIG. 2 (corresponding to the time point t3 to a time point t4 in FIG. 8).

First, at a step S51, it is determined whether or not the pressure-recovering mode permission flag FEVP3 has been set to "1". If FEVP3=0 holds, i.e. if execution of the pressure-recovering mode is not permitted, the program is immediately terminated.

On the other hand, if FEVP3=1 holds at a step S51, it is determined at a step S52 whether or not the value of the timer T exceeds a predetermined pressure-recovering time period T3. In the first loop of execution of the step S52, T<T3 holds, and then the program proceeds to a step S53, wherein the pressure-recovering mode is set by opening the bypass valve 24 and the vent shut valve 26, and closing the purge control valve 30 (the same valve states as in the open-to-atmosphere mode), followed by terminating the present routine.

If the predetermined pressure-recovering time period T3 has elapsed, the program proceeds from the step S52 to a step S54, wherein calculations are made of a pressure difference DP1 (=PPREND–P1, hereinafter referred to as "the first pressure difference") between a present value of the tank internal pressure PTANK (tank internal pressure PPREND assumed when the pressure-recovering mode is terminated at the time point t4 in FIG. 8) and the first detected pressure P1, and a pressure difference DP3 (=PPREND–P3, hereinafter referred to as "the third pressure difference") between the value PPREND and the third detected pressure P3. Further, it is determined at a step S55 whether or not the second pressure difference DP2 is smaller than a second threshold value PT2.

If DP2<PT2 holds at the step S55, which means that a change in pressure during the leak-checking mode is small, it is determined that the evaporative purging system 31 is normal or it has a medium-sized hole or a large-sized hole formed therein. Then, it is determined at a step S56 whether or not the third pressure difference DP3 is smaller than a third threshold value PT3. If DP3≧PT3 holds, which means that the third detected pressure P3 is lower than the tank internal pressure PPREND (almost equal to the atmospheric pressure PATM) at the time point t4 by a predetermined amount or more. Therefore, it is determined at a step S57 that the evaporative purging system 31 is normal, and then the abnormality-determination is terminated at a step S61 without executing a processing of FIG. 7, hereinafter described.

On the other hand, if DP3<TP3 holds at the step S56, which means that the third detected pressure P3 is almost equal to the atmospheric pressure PATM, it is determined at a step S58 that a large-sized hole or a medium-sized hole is present in the evaporative purging system 31. Therefore, the program is terminated at the step S61 without executing the processing of FIG. 7.

On the other hand, if DP2≧PT2 holds at the step S55, which means that the change in pressure during the leak-checking mode is large, it is determined that the cut-off valve 21 is closed (i.e. the fuel tank 9 is full), or the evaporative purging system 31 is normal and at the same time evaporative fuel is generated in the fuel tank 9 in an extremely large amount, or a small hole is present in the system 31. Then, it is determined at a step S59 whether or not the first pressure difference DP1 is larger than the first threshold value PT1. If DP1>TP1 holds, which means that the first detected pressure DP1 is low, it is determined that the fuel tank 9 is full to close the cut-off valve 21. Therefore, the determination as to abnormality is suspended, and the abnormality determination is terminated at the step S61 without executing the processing of FIG. 7.

If DP1≦PT1 holds at the step S59, it is determined that the system 31 is normal or has a small hole formed therein. Then, at a step S60, the pressure-recovering mode permission flag FEVP3 is set to "0", a corrective checking mode permission flag FEVP4, which, when set to "1", indicates that execution of the corrective checking mode is permitted, is set to "1", and the timer T is reset to "0", followed by terminating the present routine.

Figure 7:
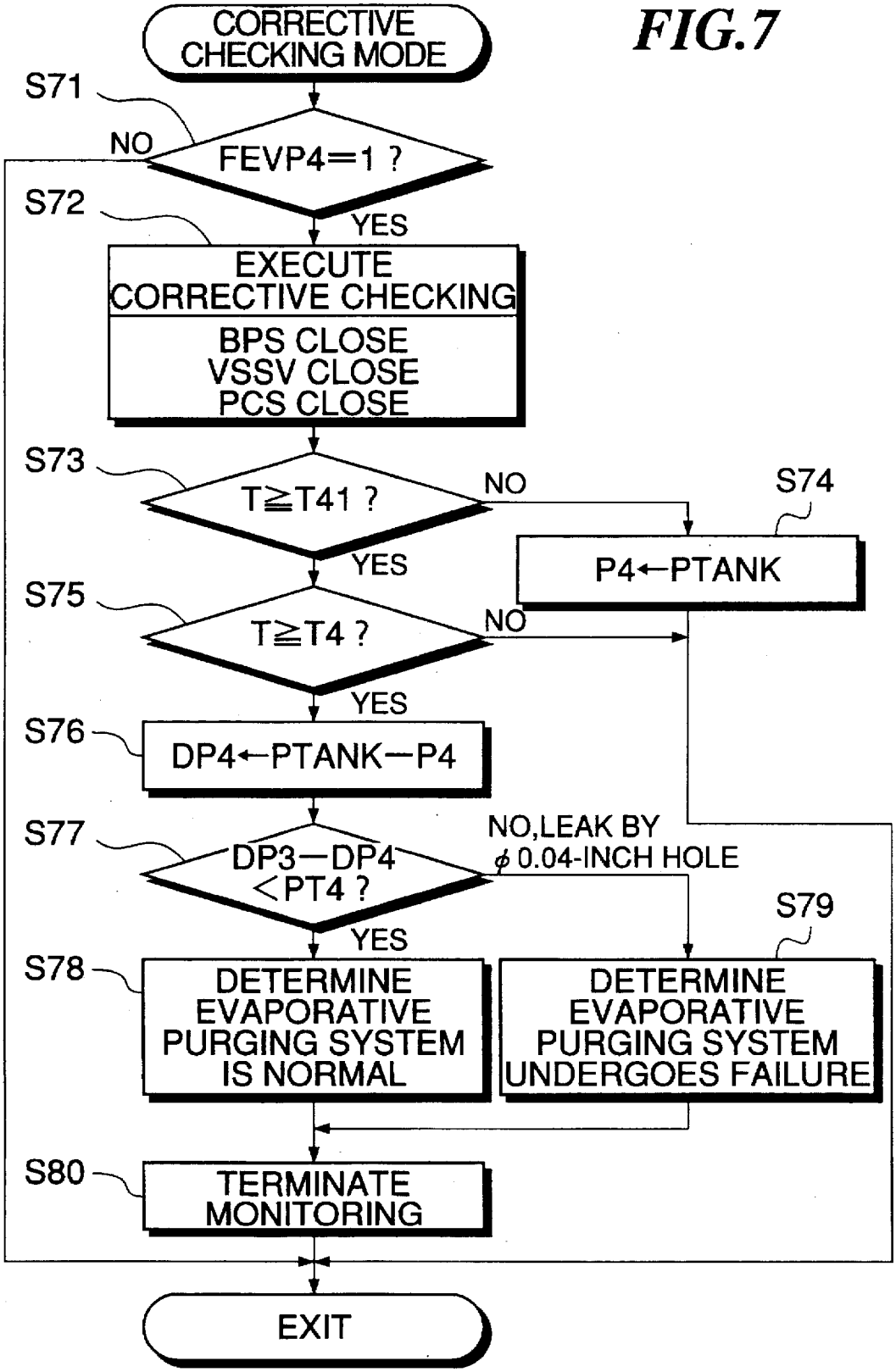
FIG. 7 is a flowchart showing a subroutine for carrying out a corrective checking mode processing, which is executed at a step S7 in FIG. 2.

FIG. 7 shows a subroutine for carrying out the corrective checking mode processing executed at the step S7 in FIG. 2 (corresponding to the time point t4 to a time point t5 in FIG. 8).

First, at a step S71, it is determined whether or not the corrective checking mode permission flag FEVP4 assumes "1" If FEVP4=0 holds, i.e. if execution of the corrective checking mode processing is not permitted, the program is immediately terminated.

If FEVP4=1 holds at the step S71, the program proceeds to a step S72, wherein the bypass valve 24, the vent shut valve 26 and the purge control valve 30 are all closed, similarly to the leak-checking mode, to thereby execute the corrective checking mode processing. Then, it is determined at a step S73 whether or not the value of the timer T exceeds a predetermined delay time T41. In the first loop of execution of the step S73, T<T41 holds, and then the program proceeds to a step S74, wherein a present value of the tank internal pressure PTANK is set to a fourth detected pressure P4, followed by terminating the present routine.

After the predetermined delay time T41 has elapsed, the program proceeds from the step S73 to a step S75, and therefore the fourth detected pressure P4 is updated to a value of the tank internal pressure PTANK assumed when the predetermined delay time T41 has elapsed from the corrective checking mode starting time point t4.

At the step S75, it is determined whether or not the value of the timer T exceeds a predetermined corrective checking time period T4. In the first loop of execution of the step S75, T<T4 holds, and then the present program is immediately terminated. If T=T4 holds, the program proceeds from the step S75 to a step S76.

At the step S76, a pressure difference DP4 (=PCCEND–P4, hereinafter referred to as "the fourth pressure difference") between a present value of the tank internal pressure PTANK (tank internal pressure PCCEND assumed at the time point t5 in FIG. 8) and the fourth detected pressure P4 is calculated. Then, it is determined at a step S77 whether or not a difference (=DP3–DP4) between the third pressure difference DP3 and the fourth pressure difference DP4 is smaller than a fourth threshold value PT4.

If (DP3–DP4)<PT4 holds, which means that the difference between the third pressure difference DP3 and the fourth pressure difference DP4 is small, it is determined at a step S78 that the large change in pressure (second pressure difference DP2) during the leak-checking mode was caused by generation of a large amount of evaporative fuel and hence the evaporative purging system 31 is normal, followed by terminating the abnormality determination at a step S80.

On the other hand, if (DP3–DP4)≧PT4 holds, it is determined at a step S79 that the large change in pressure (second pressure difference DP2) during the leak-checking mode was caused by a small hole (e.g. a hole with a diameter of approximately 0.04 inches) present in the evaporative purging system 31, followed by terminating the abnormality determination at the step S80.

As described hereinabove, according to the present embodiment, in addition to the detected pressures P2 and PLCEND (see FIG. 8) which have been used in the prior art abnormality determination, the detected pressures P1 and P3 are employed in the abnormality determination. As a result, even if a large hole is present in the system 31, or the fuel tank 9 is full (the cut-off valve 21 is closed), these states can be precisely discriminated without error, whereby the determination as to presence/absence of leakage can be accurately carried out. Further, the detected pressures P1 and P3 per se are not applied in carrying out the determination, but the pressure differences DP1 and DP3 between the detected pressure PPREND assumed at the termination of the pressure-recovering mode and the respective detected pressures P1 and P3 are applied. As a result, even if a deviation in the output value from the pressure sensor 11 occurs due to aging or the like, accurate abnormality determination can be ensured.

A summary of the above described manners of the abnormality determination according to the present embodiment are shown in a table below:

TABLE

| REFERENCE VALUES (RLT) | | DP2 | DP3 | DP1 | DP3–DP4 |
|---|---|---|---|---|---|
| THRESHOLD VALUES (LMT) | | PT2 | PT3 | PT1 | PT4 |
| (1) | NORMAL | RLT < LMT<br>RLT >LMT | RLT>LMT | RLT < LMT | RLT < LMT |
| (2) | ϕ 0.04 INCH LEAK | RLT > LMT | | RLT < LMT | RLT >LMT |
| (3) | LARGE HOLE | RLT < LMT | RLT < LMT | | |
| (4) | FUEL TANK IS FULL | RLT > LMT | | RLT > LMT | |

Symbols in the top row in the table indicate kinds of reference values RLT, i.e. parameters employed for the abnormality determination, and symbols in the second row indicate kinds of threshold values LMT employed for the abnormality determination. Symbols in the third row et seq. indicate conditions which satisfy respective cases, i.e. (1) where the evaporative purging system 31 is normal, (2) where the system 31 has a small hole (with a diameter of approximately 0.04 inches), (3) where the system 31 has a large (or medium) hole, and where the fuel tank is filled (the cut-off valve 21 is closed).

More specifically, if the second pressure difference DP2 is smaller than the second threshold value PT2 and at the same time the third pressure difference DP3 is larger than the third threshold value PT3 (steps S55→S56→S57 in FIG. 6), or if the second pressure difference DP2 is larger than the second threshold value PT2, at the same time the first pressure difference DP1 is smaller than the first threshold value PT1, and at the same time the difference (DP3–DP4) between the third pressure difference and the fourth difference is smaller than the fourth threshold value PT4 (steps S55→S59→S60 in FIG. 6 and steps S77→S78 in FIG. 7), the evaporative purging system 31 is determined to be normal.

If the second pressure difference DP2 is larger than the second threshold value PT2, at the same time the first pressure difference DP1 is smaller than the first threshold value PT1, and at the same time the difference (DP3–DP4) between the third pressure difference and the fourth pressure difference is larger than the fourth threshold value PT4 (steps S55→S59→S60 in FIG. 6 and steps S77→S79 in FIG. 7), the evaporative purging system 31 is determined to have a small hole formed therein.

Further, if the second pressure difference DP2 is smaller than the second threshold value PT2 and at the same time the third pressure difference DP3 is smaller than the third threshold value PT3 (steps S55→S56→S58 in FIG. 6), the evaporative purging system 31 is determined to have a large hole formed therein.

Still further, if the second pressure difference DP2 is larger than the second threshold value PT2 and at the same time the first pressure difference DP1 is larger than the first threshold value PT1 (steps S55→S56→S61 in FIG. 6), the fuel tank 9 is determined to be full.

Although in the above described embodiment the pressure sensor 11 is inserted into the charging passage 20 at a location shown in FIG. 1, this is not limitative. Alternatively, it may be directly arranged in the fuel tank 9 or arranged in the charging passage 20 at a location intermediate between the canister 25 and the two-way valve 23.

As described in detail, according to the present invention, the determination as to whether a leak occurs from the evaporative purging system can be carried out based on the at least two pressure values detected within the predetermined time period, whereby it is possible to discriminate a state where a large hole is present, a state where a small hole is present, or a state where the cut-off valve is operated to close the charging passage between the canister and the fuel tank. As a result, accurate leak checking can be carried out in a manner dependent on various states.

What is claimed is:

1. An evaporative fuel-processing system for an internal combustion engine having an intake system, and a fuel tank, comprising:

an evaporative emission control system including a canister having an adsorbent accommodated therein, for adsorbing evaporative fuel generated in said fuel tank, and an air inlet port communicating with atmosphere, a charging passage extending between said canister and said fuel tank, a purging passage extending between said canister and said intake system, a purge control valve arranged across said purging passage, and a vent shut valve for opening and closing said air inlet port of said canister;

pressure-detecting means for detecting pressure within said evaporative emission control system;

negatively pressurizing means for negatively pressurizing an interior of said evaporative emission control system into a predetermined negatively pressurized state, by opening said purge control valve and closing said vent shut valve;

leakage-checking means for closing said purge control valve over a predetermined time period after said interior of said evaporative emission control system is brought into said predetermined negatively pressurized state by said negatively pressurizing means, and for detecting a rate of decrease in negative pressure within said evaporative emission control system by using first and second pressure values detected respectively at first and second predetermined time points within said predetermined time period; and leakage-determining means for determining whether or not there is leakage from said evaporative emission control system, based on said rate of decrease in said negative pressure within said evaporative emission control system detected by said leakage-checking means, and a third pressure value detected by said pressure-detecting means at a third predetermined time point exclusive of said first and second time point within said predetermined time period over which said purge control valve is closed.

2. An evaporative fuel-processing system as claimed in claim 1, including pressure-recovering means for relieving said interior of said evaporative emission control system into the atmosphere after lapse of said predetermined time period over which said purge control valve is closed by said leakage-checking means, to bring said evaporative emission control system into an open-to-atmosphere state in which said pressure within said evaporative emission control system is substantially equal to atmospheric pressure, and wherein said leakage-determining means determines whether or not there is leakage from said evaporative emission control system, based on said rate of decrease in said negative pressure, and a difference between a pressure value detected by said pressure-detecting means when said emission control system was brought into said open-to-atmosphere state and said at least one pressure value detected by said pressure-detecting means at said at least one predetermined time point within said predetermined time period over which said purge control valve is closed.

3. An evaporative fuel-processing system for an internal combustion engine having an intake system, and a fuel tank, comprising:

an evaporative emission control system including a canister having an adsorbent accommodated therein, for adsorbing evaporative fuel generated in said fuel tank, and an air inlet port communicating with atmosphere, a charging passage extending between said canister and said fuel tank, a purging passage extending between said canister and said intake system, a purge control valve arranged across said purging passage, and a vent shut valve for opening and closing said air inlet port of said canister;

pressure-detecting means for detecting pressure within said evaporative emission control system;

negatively pressurizing means for negatively pressurizing an interior of said evaporative emission control system into a predetermined negatively pressurized state, by opening said purge control valve and closing said vent shut valve; and leakage-checking means for closing said purge control valve after the bringing of said evaporative emission control system into said predetermined negatively pressurized state by said negatively pressurizing means, and determining whether or not there is leakage from said evaporative emission control system, based on rates of decrease in negative pressure within said evaporative emission control system, calculated from first to third pressure values (P1, P2 and P3) within said evaporative emission control system, detected by said pressure-detecting means, said first pressure value (P1) being detected when a first predetermined time period (T21) has elapsed after the closing of said purge control valve by said leakage-checking means, said second pressure value (P2) being detected when a second predetermined time period (T22) has elapsed after the closing of said purge control valve by said leakage-checking means, said third pressure value (P3) being detected when a third predetermined time period (T23) has elapsed after the closing of said purge control valve by said leakage-checking means.

4. An evaporative fuel-processing system as claimed in claim 3, wherein said leakage-checking means calculates a pressure difference (DP2) between a pressure value (PLCEND) detected by said pressure-detecting means when a fourth predetermined time period (T2) longer than said third predetermined time period (T23) has elapsed after the closing of said purge control valve by said leakage-checking means, and said second pressure value (P2), compares said calculated pressure difference (DP2) with a first predetermined threshold value (PT2), and determines whether or not there is leakage from said evaporative emission control system, based on a result of said comparison.

5. An evaporative fuel-processing system as claimed in claim 4, including pressure-recovering means for relieving said interior of said evaporative emission control system into the atmosphere over a fifth predetermined time period (T3) after said fourth time period (T2) has elapsed from the closing of said purge control valve by said leakage-checking means, to bring said evaporative emission control system into an open-to-atmosphere state in which said pressure within said evaporative emission control system is substantially equal to atmospheric pressure, and wherein said leakage-checking means calculates pressure differences (DP1 and DP3) between a pressure value (PPREND) detected by said pressure-detecting means when said evaporative emission control system has been brought into said open-to-atmosphere state and said first and third pressure values (P1 and P3), compares said calculated pressure differences (DP1 and DP3) with second and third predetermined threshold values (PT1 and PT3), respectively, and determines whether or not there is leakage from said evaporative emission control system, based on results of said comparisons.

6. An evaporative fuel-processing system as claimed in claim 5, wherein said leakage-checking means determines that said evaporative emission control system is normal when said pressure different (DP2) is smaller than said first predetermined threshold value (PT2) and at the same time said pressure difference (DP3) is larger than said third predetermined threshold value (PT3).

7. An evaporative fuel-processing system as claimed in claim 5, wherein said leakage-checking means determines that there is an abnormality of a large hole being present in said evaporative emission control system when said pressure difference (DP2) is smaller than said first predetermined threshold value (PT2) and at the same time said pressure difference (DP3) is smaller than said third predetermined threshold value (PT3).

8. An evaporative fuel-processing system as claimed in claim 5, wherein said pressure-recovering means brings said emission control system into said open-to-atmosphere state by opening said vent shut valve while keeping said purge control valve closed, said evaporative fuel-processing system further including corrective checking means for closing said vent shut valve while keeping said purge control valve closed after said emission control system has been brought into said open-to-atmosphere state by said pressure-recovering means.

9. An evaporative fuel-processing system as claimed in claim 8, wherein said corrective checking means closes said vent shut valve over a sixth predetermined time period (T4), said corrective checking means calculating a pressure difference (DP4) between a pressure value (PCCEND) detected by said pressure-detecting means when said sixth predetermined time period (T4) has elapsed and a pressure value (P4) detected by said pressure-detecting means when a seventh predetermined time period (T41) shorter than said sixth predetermined time period (T4) has elapsed after the opening of said vent shut valve by said corrective checking means, comparing a difference (DP3–DP4) between said pressure difference (DP3) and the calculated pressure difference (DP4) with a fourth predetermined threshold value (PT4), and determining whether or not there is leakage from said evaporative emission control system, based on a result of said comparison.

10. An evaporative fuel-processing system as claimed in claim 9, wherein said corrective checking means determines that said evaporative emission control system is normal when said pressure difference (DP2) is larger than said first predetermined threshold value (PT2), at the same time said pressure difference (DP1) is smaller than said second predetermined threshold value (PT1), and at the same time said difference (DP3–DP4) is smaller than said fourth predetermined threshold value (PT4).

11. An evaporative fuel-processing system as claimed in claim 9, wherein said corrective checking means determines that there is an abnormality of a small hole being present in said evaporative emission control system when said pressure difference (DP2) is larger than said first predetermined threshold value (PT2), at the same time said pressure difference (DP1) is smaller than said second predetermined threshold value (PT1), and at the same time said difference (DP3–DP4) is larger than said fourth predetermined threshold value (PT4).

12. An evaporative fuel-processing system as claimed in claim 5, wherein said leakage-checking means determines that said fuel tank is full when said pressure difference (DP2) is larger than said first predetermined threshold value (PT2) and at the same time said pressure difference (DP1) is larger than said second predetermined threshold value (PT1).

* * * * *